US005832887A

United States Patent [19]

Adachi et al.

[11] Patent Number: 5,832,887

[45] Date of Patent: Nov. 10, 1998

[54] ROTATIONAL PHASE ADJUSTING APPARATUS HAVING STOPPER PISTON

[75] Inventors: Michio Adachi, Obu; Teruki Kataoka, Chita, both of Japan

[73] Assignees: Denso Corporation, Kariya; Toyota Jidosha Kabushiki Kaisha, Toyota, both of Japan; a part interest

[21] Appl. No.: 933,082

[22] Filed: Sep. 18, 1997

[30] Foreign Application Priority Data

Oct. 2, 1996 [JP] Japan ..... 8-262165

[51] Int. Cl.[6] ..... F01L 1/344

[52] U.S. Cl. ..... 123/90.17; 123/90.31; 74/565 R; 464/2

[58] Field of Search ..... 123/90.15, 90.16, 123/90.17, 90.31; 74/567, 568 R; 464/1, 2, 160, 161

[56] References Cited

U.S. PATENT DOCUMENTS

| | | | |
|---|---|---|---|
| 4,858,572 | 8/1989 | Shirai et al. | 123/90.12 |
| 5,107,804 | 4/1992 | Becker et al. | 123/90.17 |
| 5,450,825 | 9/1995 | Geyer et al. | 123/90.17 |
| 5,666,914 | 9/1997 | Ushida et al. | 123/90.17 |

FOREIGN PATENT DOCUMENTS

| | | |
|---|---|---|
| 0 799 976 | 10/1997 | European Pat. Off. . |
| U-2-50105 | 4/1990 | Japan . |
| 5-195726 | 8/1993 | Japan . |
| A-6-712 | 1/1994 | Japan . |
| 2 302 391 | 1/1997 | United Kingdom . |

*Primary Examiner*—Weilun Lo
*Attorney, Agent, or Firm*—Nixon & Vanderhye P.C.

[57] ABSTRACT

In a rotational phase adjusting apparatus which may be used for adjusting valve timing of an engine, a stopper piston is set engageably into and disengageably from a tapered hole of a shoe housing so that relative pivotal motion between the shoe housing and a vane rotor is constrained at the most retarted position. A hydraulic pressure chamber communicates with a retard-side hydraulic pressure chamber while a hydraulic pressure chamber communicates with an advance-side hydraulic pressure chamber. A pressurized area of the stopper piston receiving hydraulic pressure from the hydraulic pressure chamber in a direction of releasing constraint is set to be larger than a pressurized area of the stopper piston receiving hydraulic pressure from the hydraulic pressure chamber in the direction of releasing constraint. When working oil is supplied to the advance-side hydraulic pressure chamber from a state where the stopper piston is fitted into the tapered hole, the stopper piston is drawn out from the tapered hole assuredly even in the case of low hydraulic pressure.

15 Claims, 4 Drawing Sheets

ROTATIONAL PHASE ADJUSTING APPARATUS HAVING STOPPER PISTON

CROSS REFERENCE TO RELATED APPLICATION

This application relates to and incorporates herein by reference Japanese Patent Application No. 8-262165 filed on Oct. 2, 1996.

BACKGROUND OF THE INVENTION

1. Field of the Invention:

The present invention relates to a rotational phase adjusting apparatus which may be used for adjusting valve timing for changing opening and closing timing (valve timing) of intake and/or exhaust valves of an internal combustion engine.

2. Description of Related Art:

There has been conventionally known, by U.S. Pat. No. 4,858,572 (JP-A 1-92504), a vane type rotational phase adjusting apparatus for driving a camshaft via a timing pulley or a chain sprocket rotating in synchronism with a crankshaft of an engine and controlling valve timings of intake and/or exhaust valves by a phase difference caused by a relative pivotal motion between the crankshaft (timing pulley or the chain sprocket) and the camshaft.

According to this apparatus, when the camshaft is disposed at the most retarted angular position or the most advanced angular position in respect of the timing pulley, a piston installed at one of a rotating body on the side of the timing pulley and a rotating body on the side of the camshaft, is fitted into a hole provided at the other one thereof in the radial direction by which the relative pivotal motion between the both rotating bodies is constrained. Thereby, impinging sound caused by the rotating body on the side of the timing pulley and the rotating body on the side of the camshaft can be prevented from generating even if the camshaft undergoes a positive or negative torque variation in driving the intake valves or the exhaust valves, when the camshaft is disposed at the most retarded angular position or the most advanced angular position in respect of the crankshaft.

When the phase of the camshaft with respect to the crankshaft is changed from that in a state where the piston is fitted into the hole, the piston is drawn from the hole on one side by switching hydraulic pressure by which the relative pivotal motion between the rotating body on the side of the timing pulley and the rotating body on the side of the camshaft can be performed.

However, according to this apparatus having the piston for regulating the relative pivotal motion between the rotating body on the side of the crankshaft and the rotating body on the side of the camshaft, when the operating hydraulic pressure is low at a low rotation speed of the engine, the piston may not be drawn out from the hole and the relative pivotal motion between the rotating body on the side of the crankshaft and the rotating body on the side of the camshaft may not be controlled. Further, when the operating hydraulic pressure is applied in a state where the piston is fitted into the hole, the piston and members surrounding the piston may be destructed by a rotational force of the rotating body on the side of the camshaft.

Even if the piston is once drawn out from the hole, the piston may return to the hole again, when the relative pivotal motion between the rotating body on the side of the crankshaft and the rotating body on the side of the camshaft can be performed, due to lowering of the hydraulic pressure by an increase in a volume of a hydraulic chamber caused by the pivotal motion of the rotating body on the side of the camshaft. Accordingly, the piston repeats to be put in the hole or put out of the hole until the operating hydraulic pressure rises to a predetermined pressure or higher. When the torque variation received by the camshaft is synchronized with such a motion of the piston, the rotating body on the side of the camshaft is vibrated, the rotating body on the side of the crankshaft impinges or hits on the rotating body on the side of the camshaft and an impingement sound is generated.

A hydraulic pump which supplies working oil to this apparatus normally serves also as a pump which supplies lubricant to the engine and accordingly, the hydraulic pressure supply capability is limited. Although the problem of low hydraulic pressure can be resolved by promoting the drive function of the hydraulic pump or installing a hydraulic pump exclusively for this apparatus, it is difficult to install the pump in a limited space and in addition thereto, also cost of apparatus is increased.

Although it is possible to secure a large pressure receiving face by enlarging the piston, the structure of the apparatus is enlarged. Under a situation where downsizing of the apparatus is requested, the increase in the pressurized area is also limited. When two kinds of hydraulic pressures for driving the rotating body on the side of the camshaft respectively in mutually opposed directions of angular advancement and angular retard, are introduced as the hydraulic pressures for drawing out the piston from the hole and pressure receiving faces of the both hydraulic pressures are provided, the size of the pressure receiving area is further limited.

Further, although the piston can be drawn out of the hole even under low hydraulic pressure by weakening the urging or biasing force of a spring urging the piston in a direction of fitting to the hole, the piston is likely to be drawn out prior to the rise of the hydraulic pressure to a predetermined value and the rotating body on the side of the camshaft is vibrated by torque variation received by the camshaft. Also, when the urging force of spring is weakened, foreign objects mixed in working oil enters a slidably moving portion of the piston by which the motion of the piston is hampered.

SUMMARY OF THE INVENTION

The present invention has an object to provide a rotational phase adjusting apparatus which obviates the foregoing drawbacks.

The present invention has a further object to provide a rotational phase adjusting apparatus which is capable of firmly releasing the constraint constraining a housing member and a vane member even under low pressure of working fluid and controlling a rotational phase difference.

A rotational phase adjusting apparatus according to the present invention is used for various machines having a driving shaft and a driven shaft, such as an internal combustion engine having a crankshaft and a camshaft.

Under a state where the fluid pressure is sufficiently applied, irrespective of whether the rotational phase is changed in one direction or changed in other direction, one of the pressures changes the constraining member to a state of releasing the constraint and maintains the constraining member in the state of releasing the constraint. Further, under a state where the fluid pressure can not be applied sufficiently as in starting the internal combustion engine or immediately thereafter, with respect to the two pressure receiving faces, the first pressure receiving face is set to be larger and therefore, the constraining members may be set to the state of releasing the constraint when the fluid pressure is applied to the first pressure receiving face and therefore, even in the state where only low fluid pressure can be applied, the constraining member can be changed into the state of releasing the constraint by effectively utilizing the first fluid pressure in the possible range, for example, in starting the engine, the constraining member can be changed into the state of releasing the constraint swiftly after starting.

The apparatus which sets the constraining member to the constraining state at the most retarded angular position or the most advanced angular position, can preferably be used for adjusting valve timing for driving an intake valve. In this case, after starting the engine, the constraining member must firstly be changed into the state of releasing the constraint and therefore, the first fluid pressure constitutes a pressure for driving the apparatus in an advance-side direction or a retard-side direction and the pressure is applied to the first pressure receiving face of the constraint member. Accordingly, even if the first fluid pressure is low immediately after starting the engine, the hydraulic pressure is operated on the comparatively large first pressure receiving face by which the constraining member can be changed into the state of releasing the constraint. Therefore, desired valve timing can be realized from immediately after starting the engine.

A highly reliable constraining member can be provided by using a stopper piston having two stages of outer shape as the constraining member. It is preferable that the stopper piston is arranged to displace in the axial direction to avoid influence of centrifugal force. Further, the stopper piston can be arranged selectively to either of members on the driving shaft side and the driving shaft side.

The fluid pressure is preferably applied to the first pressure receiving face after transmitting through the first chamber. The state of releasing the constraint can be effected after the fluid has been sufficiently supplied to the chamber. Thereby, it can be prevented that the constraint is released under a state where the inside of the chamber is vacant and the driven shaft is vibrated in respect of the driving shaft.

BRIEF DESCRIPTION OF THE DRAWINGS

Other objects, features and advantages of the present invention will be made more apparent by the following detailed description with reference to the accompanying drawings, in which.

DETAILED DESCRIPTION OF THE PREFERRED EMBODIMENT

The present invention will be described in detail with reference to various embodiments throughout which the same or similar parts are denoted by the same or similar numerals.

(First Embodiment)

Figure 1:
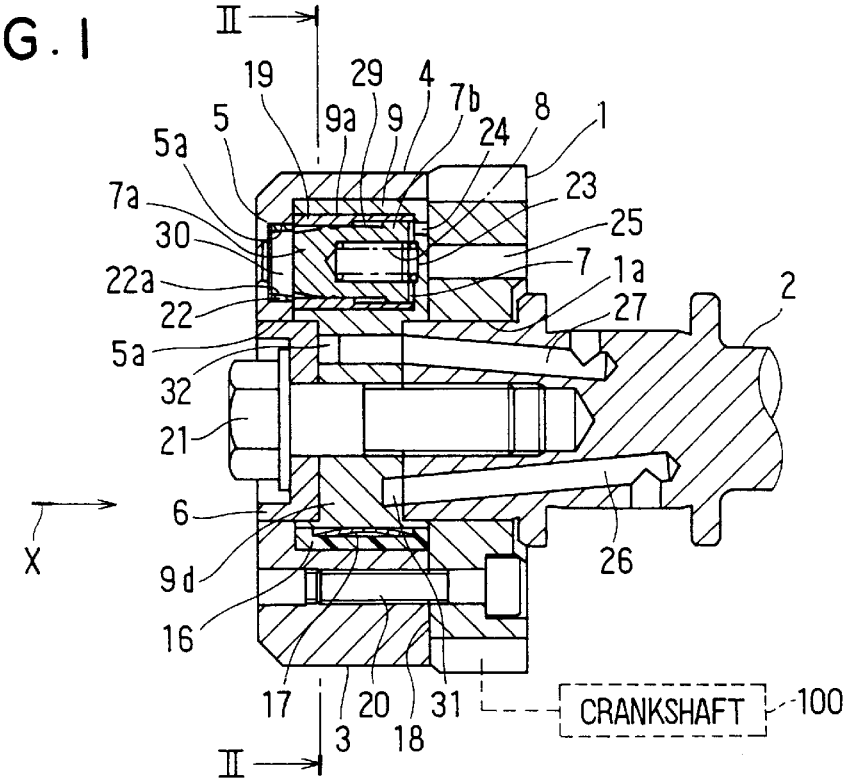
FIG. 1 is a sectional view showing a rotational phase adjusting apparatus according to a first embodiment.
Figure 2:
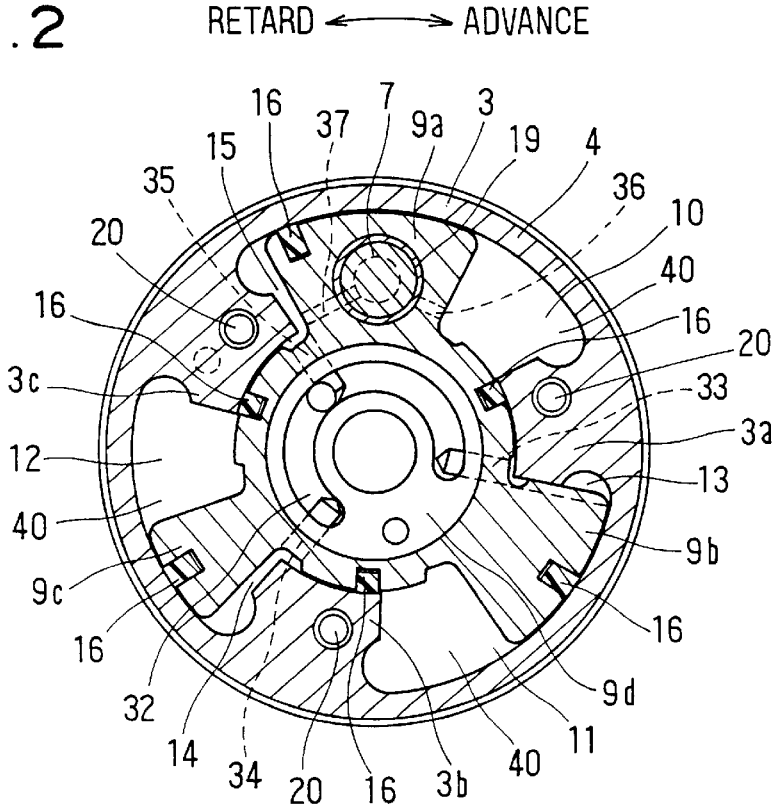
FIG. 2 is a sectional view taken along the line II—II in FIG. 1.

In the first embodiment shown in FIG. 1 and FIG. 2, a rotational phase adjusting apparatus is constructed as a hydraulic pressure control type having a vane rotor to control valve timing of intake valves of an internal combustion engine.

A timing gear 1 constituting one side wall of a housing member is transmitted with a drive force by being coupled with a crankshaft 100 that is a driving shaft of the engine (not illustrated), by a gear train (not illustrated) and is rotated in synchronism with the crankshaft 100. A camshaft 2 that is a driven shaft, is transmitted with the drive force from the timing gear 1 and drives to open and close the intake valves (not illustrated). The camshaft 2 can be pivoted relative to the timing gear 1 with a predetermined phase difference. The timing gear 1 and the camshaft 2 are rotated in the clockwise direction in view from an arrow mark direction X shown in FIG. 1. This rotating direction is defined as an advance-side direction.

A rear plate 18 formed in a thin plate shape is interposed between the timing gear 1 and a shoe housing 3. The rear plate 18 prevents oil from leaking from an intermediary between the timing gear 1 and the shoe housing 3. The timing gear 1, the shoe housing 3 and the rear plate 18 constitute an integral housing member that is a driving side rotating body and are fixed coaxially by bolts 20.

The shoe housings 3 comprises a cylindrical peripheral wall 4 and a front plate 5 that is the other side wall and is integrally formed therewith. The shoe housing 3 is provided with shoes 3*a*, 3*b* and 3*c* each being formed in a trapezoidal shape at equal angular intervals in the circumferential direction. Fan-like space portions 40 are formed as vane accomodating chambers for accomodating vanes 9*a*, 9*b* and 9*c* which are respectively provided in the spaces defined by the shoes 3*a*, 3*b* and 3*c* at three locations in the circumferential direction. Sections of inner peripheral faces of the shoes 3*a*, 3*b* and 3*c* are formed in a circular shape.

A vane rotor 9 is provided with the vanes 9*a*, 9*b* and 9*c* at substantially equal angular intervals in the circumferential direction. The vane rotor 9 and a bushing 6 are integrally fixed to the camshaft 2 by a bolt 21 thereby constituting a driven side rotating body.

The camshaft 2 and the bushing 6 are fitted respectively to an inner peripheral wall 1*a* of the timing gear 1 and an inner peripheral wall 5*a* of the front plate 5 pivotably relative thereto. Accordingly, the camshaft 2 and the vane rotor 9 are coaxially pivotable relative to the timing gear 1 and the shoe housing 3. The inner peripheral wall 1*a* of the timing gear 1 and the inner peripheral wall 5*a* of the front plate 5 constitute a bearing portion of the driven side rotating body.

Seal members 16 are fitted into an outer peripheral wall of the vane rotor 9. A very small clearance is provided between the outer peripheral wall of the vanes 9*a*, 9*b* and 9*c* of the vane rotor 9 and the inner peripheral wall of the peripheral wall 4 so that working oil is prevented from leaking among hydraulic pressure chambers via the clearance by means of the seal members 16. The seal members 16 are pushed toward the peripheral wall 4 respectively by the urging force of leaf springs 17.

A guide ring 19 is press-fitted into and held by an inner wall of the vane 9*a* forming an accomodating hole 23, and a stopper piston 7 that is an abutting portion is inserted into the guide ring 19. The stopper piston 7 comprises a bottomed cylindrical portion 7*a* and a flange portion 7*b* provided at an opening end of the cylindrical portion 7*a*. The stopper piston 7 is accomodated in the guide ring 19 slidably in the axial direction of the camshaft 2 and is urged to the side of the front plate 5 by a spring 8. A guide ring 22 having a tapered hole 22*a* that is an abutted portion is press-fitted into and held by a stopper hole 5*b* formed in the front plate 5 and the stopper piston 7 can be fitted into the tapered hole 22*a* at its tapered surface. When the stopper piston 7 is fitted into the tapered hole 22*a*, the relative pivotal movement of the vane rotor 9 in respect of the shoe housing 3 is constrained.

A hydraulic pressure chamber 29 on the left side of the flange portion 7*b* communicates with a retard-side hydraulic pressure chamber 10 via an oil passage 36. A hydraulic pressure chamber 30 formed at the front end side of the cylindrical portion 7*a* communicates with an advance-side hydraulic pressure chamber 15 via an oil passage 37. The area of a first pressure receiving surface or face of the cylindrical portion 7*a* receiving the hydraulic pressure of the hydraulic pressure chamber 30 is set to be larger than an area of a second pressure receiving surface or face of the flange portion 7*b* receiving the hydraulic pressure of the hydraulic pressure chamber 29. Forces received by the first pressure receiving face and the second pressure receiving face respectively from working oil in the hydraulic chamber 30 and the hydraulic chamber 29 are operated in a direction of drawing the stopper piston 7 from the tapered hole 22*a*. The pressurized area of the first pressure receiving face is substantially equal to a sectional area of the tapered end of the cylindrical portion 7*a* and the pressurized area of the second pressure receiving face is substantially equal to an area of an annular portion corresponding to a difference between diameters of the flange portion 7*b* and the cylindrical portion 7*a*. When working oil having a predetermined pressure or higher is applied to the advance-side hydraulic pressure chamber 15 or retard-side haydraulic pressure chamber 10, the stopper piston 7 is drawn out from the tapered hole 22*a* by the hydraulic pressure of the working oil against the urging force of the spring 8.

The position of the stopper piston 7 and the position of the tapered hole 22*a* are set such that the stopper piston 7 can be fitted into the tapered hole 22*a* by the urging force of the spring 8 when the vane rotor 9 is disposed at the most retarded angular position with respect to the shoe housing 3, that is, when the camshaft 2 is disposed at the most retarded angular position in respect of the crankshaft 100.

A communicating passage 25 formed in the timing gear 1 communicates with the accomodating hole 23 on the right side of the flange portion 7*b* via a communicating passage 24 formed in the vane 9*a* and is also opened to the atmosphere. Accordingly, the movement of the stopper piston 7 is not hampered.

The retard-side hydraulic pressure chamber 10 is formed between the shoe 3*a* and the vane 9*a*, a retard-side hydraulic pressure chamber 11 is formed between the shoe 3*b* and the vane 9*b* and a retarded hydraulic chamber 12 is formed between the shoe 3*c* and the vane 9*c*. Further, an advanced hydraulic pressure chamber 13 is formed between the shoe 3*a* and the vane 9*b*, an advance-side hydraulic pressure chamber 14 is formed between the shoe 3*b* and the vane 9*c* and the advance-side hydraulic pressure chamber 15 is formed between the shoe 3*c* and the vane 9*a*.

An oil passage 31 is provided at a portion of a boss portion 9*d* of the vane rotor 9 in abutment with the camshaft 2 and an oil passage 32 is provided at a portion thereof in abutment with the bushing 6. The oil passages 31 and 32 are respectively formed in a circular arc shape. The oil passage 31 communicates with a hydraulic pump or a drain as driving source (not illustrated) via an oil passage 26. The hydraulic pump also serves as a drive source of lubricant for engine. Further, the oil passage 31 communicates with the retard-side hydraulic pressure chambers 10, 11 and 12 via oil passages (not illustrated) and communicates with the hydraulic pressure chamber 29 via the oil passage 36. The hydraulic pressure of working oil supplied to the retard-side hydraulic pressure chambers 10, 11 and 12 provide a second fluid pressure.

The oil passage 32 communicates with a hydraulic pump or a drain via an oil passage 27. Further, the oil passage 32 communicates with the advance-side hydraulic pressure chambers 13, 14 and 15 via oil passages 33, 34 and 35 and communicates with the hydraulic pressure chamber 30 via the advance-side hydraulic pressure chamber 15 and the oil passage 37. The hydraulic pressure of working oil supplied to the advance-side hydraulic pressure chambers 13, 14 and 15 provide a first fluid pressure.

The rotational phase adjusting apparatus operates as follows.

In starting the engine, when working oil is not yet introduced from the hydraulic pump to the hydraulic pressure chambers 29 and 30, with rotation of the crankshaft 100, the vane rotor 9 is disposed at the most retard-side position shown in FIG. 2 in respect of the shoe housing 3. The front end tapered portion of the cylindrical portion 7*a* of the stopper piston 7 is fitted into to the tapered hole 22*a* by the urging force of the spring 8 and the vane rotor 9 and the shoe housing 3 are solidly constrained by this fitting. Accordingly, even if the camshaft 2 undergoes positive or negative torque variation in driving the intake valves, the motion of the vane rotor 9 to the retard-side side and the advance-side side in respect of the shoe housing 3 is restricted by which relative rotational vibration is not generated and occurrence of impinging sound by the impingement of the shoe housing 3 on the vane rotor 9 is prevented.

After starting the engine, firstly, the working oil is supplied to the respective retard-side hydraulic pressure chambers 10, 11 and 12. When the working oil is supplied from the hydraulic pump, the working oil is introduced from the oil passage 31 to the retarded hydraulic pressure chambers 10, 11 and 12 via oil passages (not illustrated). Further, the working oil is introduced from the retard-side hydraulic pressure chamber 10 to the hydraulic pressure chamber 29 via the oil passage 36. When the hydraulic pressure of the working oil supplied to the retard-side hydraulic pressure chamber 10 reaches a predetermined pressure or higher, by the force received by the second pressure receiving face of the stopper piston 7 from the hydraulic pressure chamber 29, the stopper piston 7 is drawn out from the tapered hole 22*a* against the urging force of the spring 8 as shown in FIG. 1, and the vane rotor 9 is released of the constraint with the shoe housing 3.

Since the pressurized area of the second pressure receiving face is smaller than the pressurized area of the first pressure receiving face, when the rotation speed of engine is low, the hydraulic pressure of the working oil may not reach the hydraulic pressure necessary for drawing out the stopper piston 7 from the tapered hole 22*a* and the shoe housing 3 and the vane rotor 9 may stay constrained to each other. However, there poses no problem even if the stopper piston 7 is held fitted in the tapered hole 22*a*, and the shoe housing 3 and the vane rotor 9 are constrained to each other until the vane rotor 9 is advanced in respect of the shoe housing 3.

Even if the stopper piston 7 is drawn out from the tapered hole 22*a*, the vane rotor 9 receives the hydraulic pressure in the retard-side direction from the retard-side hydraulic pressure chambers 10, 11 and 12 and further, an average value of positive or negative torque variation received by the camshaft 2, urges the vane rotor 9 to the retard-side side in respect of the shoe housing 3 and therefore, the vane rotor 9 is still maintained at the most retard-side position shown in FIG. 2 in respect of the shoe housing 3, that is, at the side of the one end portion of the accomodating chamber 40 in the peripheral direction. Therefore, occurrence of impinging sound caused by the vane rotor 9 and the shoe housing 3 is restrained.

Next, when the hydraulic pressure is switched from the state shown in FIG. 2, the retard-side hydraulic pressure chambers 10, 11 and 12 are opened to the atmosphere and the working oil is supplied to the advance-side hydraulic pressure chambers 13, 14 and 15, the vane rotor 9 is moved in the right direction in FIG. 2, that is, in the advance-side direction in respect of the shoe housing 3 under a state where the stopper piston 7 is drawn out from the tapered hole 22*a*. By adjusting the hydraulic pressure of the respective hydraulic chambers, the relative phase difference of the vane rotor 9 in respect of the shoe housing 3, that is, the relative phase difference of the camshaft 2 in respect of the crankshaft 100 can be controlled.

When the rotation speed of the engine is lowered and the hydraulic pressure of the retard-side hydraulic pressure chamber 10 is lowered at the most retarded angel position shown in FIG. 2, as mentioned above, the stopper piston 7 may be fitted into the tapered hole 22*a*. When the working oil is at high temperatures, the hydraulic pressure of the working oil is further lowered. However, according to the first embodiment, the pressurized area of the first pressure receiving face of the stopper piston 7 receiving the hydraulic pressure of the advance-side hydraulic pressure chamber 15 is set to be larger than the pressurized area of the second pressure receiving face of the stopper piston 7 receiving the hydraulic pressure of the retard-side hydraulic pressure chamber 10 and accordingly, even if the hydraulic pressure of the advance-side hydraulic pressure chamber 15 is at a low pressure, the force received by the stopper piston 7 in a direction of releasing the constraint is provided with a magnitude necessary for keeping the stopper piston 7 disengaged from the tapered hole 22*a*. Accordingly, the vane rotor 9 can be rotated firmly and swiftly from the most retard-side position to the advance-side side without being constrained by the stopper piston 7. Further, it can also be prevented that the stopper piston 7 stays fitted in the tapered hole 22*a* even if the vane rotor 9 is likely to rotate to the advance-side side and accordingly, destruction of members caused by application of the rotational force of the vane rotor 9 on the stopper piston 7 can be prevented.

Further, even if with rotation of the vane 9*a* from the most retard-side position to the advance-side side, the volume of the advance-side hydraulic pressure chamber 15 is increased and the hydraulic pressure of the hydraulic chamber 30 is lowered along with the hydraulic pressure of the advance-side hydraulic pressure chamber 15, the state where the stopper piston 7 is not fitted into the tapered hole 22*a* and is drawn out from the tapered hole 22*a*, is held. Accordingly, the vane rotor 9 can be smoothly rotated from the most retard-side position to the advance-side side without being constrained by the stopper piston 7.

When the vane rotor 9 is rotated from the most retard-side position to the advance-side side in respect of the shoe housing 3, the stopper piston 7 is not fitted into the tapered hole 22*a* since the positions of the stopper piston 7 and the tapered hole 22*a* in the circumferential direction are shifted from each other.

When the engine is stopped, the working oil is not supplied to the retard-side hydraulic pressure chambers 10, 11 and 12 and the advance-side hydraulic pressure chambers 13, 14 and 15 and accordingly, the vane rotor 9 is stopped at the most retard-side position shown in FIG. 2 in respect of the shoe housing 3 by the positive or negative torque variation received by the camshaft 2. The working oil is not supplied either to the hydraulic chambers 29 and 30 and accordingly, the stopper piston 7 is fitted into the tapered hole 22*a* by the urging force of the spring 8.

According to the first embodiment explained above, the first pressurized area of the stopper piston 7 is set to be larger than the second pressurized area thereof by which when the vane rotor 9 receives the hydraulic pressure from the state where the vane rotor 9 is constrained by the shoe housing 3 at the most retard-side position to the advance-side side, by the hydraulic pressure to the advance-side side, the constraint between the shoe housing 3 and the vane rotor 9 can firmly be released even with the limited driving force of the hydraulic pressure and the limited pressurized area of the stopper piston 7 by which the vane rotor 9 can be rotated to the advance-side side.

Further, the urging force of the spring 8 need not be weakened and accordingly, even if foreign objects invade the sliding portion between the stopper piston 7 and the guide rings 19 and 22, the stopper piston 7 can be moved against the resistance.

Further, the working oil is supplied to the hydraulic pressure chamber 30 where the first pressure receiving face receives the hydraulic pressure via the advance-side hydraulic pressure chamber 15 and therefore, compared with a construction where the working oil is supplied not via the advance-side hydraulic pressure chamber 15 but via an exclusive oil passage, the hydraulic pressure of the hydraulic chambers 30 is not increased more swiftly than the pressure in the advance-side hydraulic pressure chamber 15. Therefore, in switching the valve timing from the most retard-side position to the advance-side side, it can be prevented that only the stopper piston 7 is drawn out from the tapered hole 22*a* before the hydraulic pressure of the advance-side hydraulic pressure chamber reaches a predetermined pressure necessary for rotating the vane rotor 9 and as the result, the vane rotor 9 impinges on the shoe housing 3 by the torque variation of cams whereby impinging sound occurs.

Further, the axial length of the slidable clearance between the front plate 5 and the bushing 6 is short and therefore, air in the respective hydraulic pressure chambers can easily be discharged from the slidable clearance. Meanwhile, when air in the respective hydraulic pressure chambers is difficult to discharge, air remaining in the retard-side hydraulic pressure chamber 10, for example, in a state shown in FIG. 2 in starting the engine, may be compressed and pressurized by the pressure of the working oil supplied to the retard-side hydraulic pressure chamber 10 and the stopper piston 7 may be drawn out from the tapered hole 22*a* before the hydraulic pressure of the retarded hydraulic pressure chamber 10 reaches a predetermined pressure. Then, the constraint between the shoe housing 3 and the vane rotor 9 is released before the hydraulic pressure of the retard-side hydraulic pressure chamber 10 reaches a hydraulic pressure necessary for pushing the vane rotor 9 to the retard-side side against the variation of torque of cams and therefore, the vane rotor 9 is vibrated by the positive or negative torque variation received by the camshaft 2 and the shoe housing 3 and the vane rotor 9 impinge with each other whereby impinging sound occurs. According to the first embodiment, as mentioned above, air in the respective hydraulic pressure chambers is easily discharged from the clearance between the front plate 5 and the bushing 6 and accordingly, such a problem is not caused.

(Second Embodiment)

Figure 3:
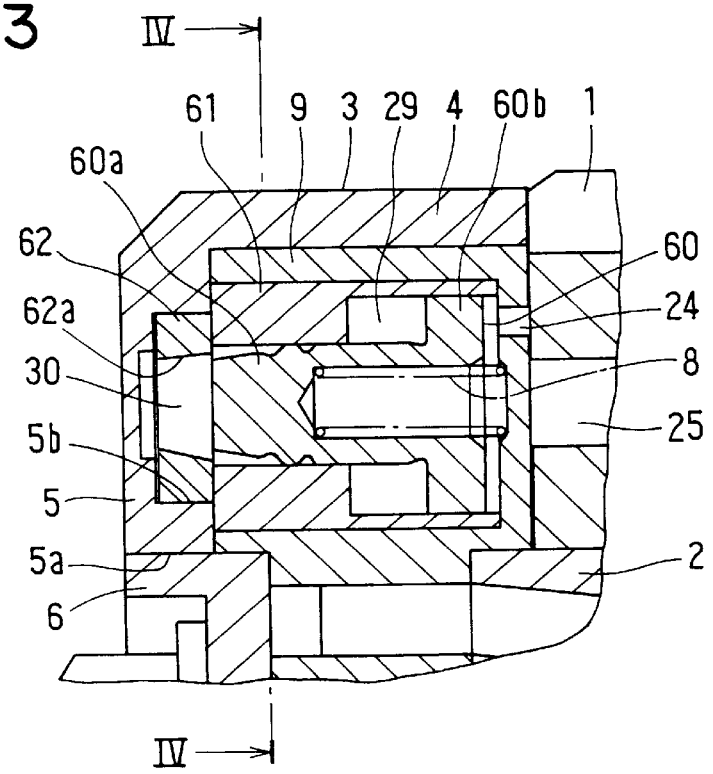
FIG. 3 is a sectional view showing partially a rotational phase adjusting apparatus according to a second embodiment.
Figure 4:
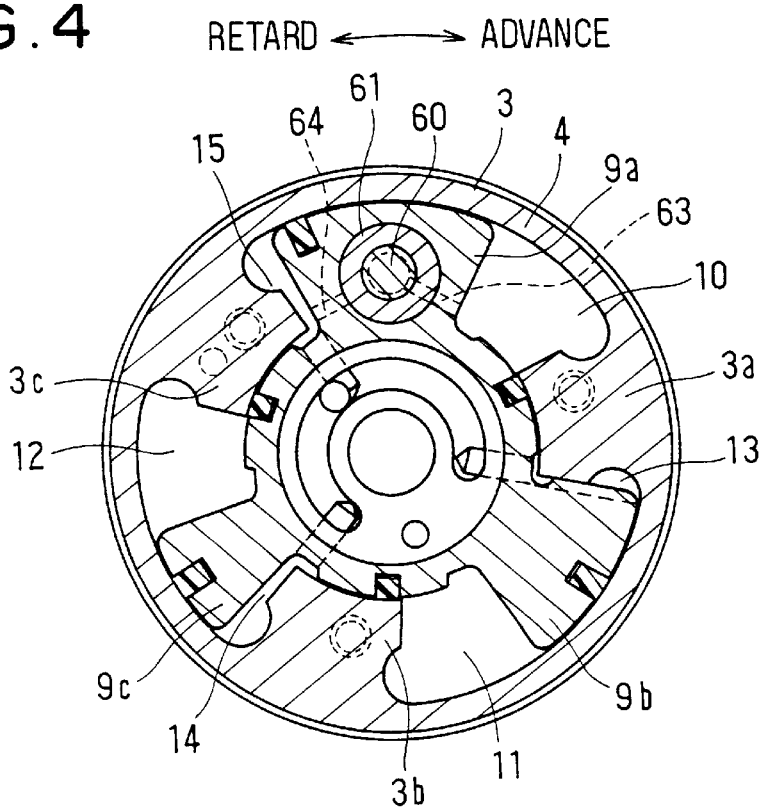
FIG. 4 is a sectional view taken along the line IV—IV in FIG. 3.

In the second embodiment shown in FIG. 3 and FIG. 4, the stopper piston 60 is fitted into a tapered hole 62*a* of a guide ring 62 when the vane rotor 9 is disposed at the most retarded angular position in respect of the shoe housing 3 so that the relative pivotal motion between the shoe housing 3 and the vane rotor 9 is constrained The diameter of the cylindrical portion 60*a* of the stopper piston 60 is smaller than that of the cylindrical portion 7*a* of the stopper piston 7 in the first embodiment and inner diameters of a guide ring 61 and the guide ring 62 become smaller. Thereby, the pressurized area of the pressure receiving face of the stopper piston 60 receiving the hydraulic pressure from the hydraulic chamber 29 in a direction of drawing out from the tapered hole 62*a* is larger than the pressurized area of the pressure receiving face of the stopper piston 60 receiving the hydraulic pressure from the hydraulic chamber 30 in the direction of drawing out from the tapered hole 62*a*. Further, the hydraulic pressure chamber 29 communicates with the advance-side hydraulic pressure chamber 15 via an oil passage 64 and the hydraulic pressure chamber 30 communicates with the retard-side hydraulic pressure chamber 10 via an oil passage 63. That is, the communications between the retard-side hydraulic pressure chamber 10 and the advance-side hydraulic pressure chamber 15, and the hydraulic pressure chamber 29 and the hydraulic pressure chamber 30 are reverse to those in the first embodiment. Accordingly, the pressure receiving face of the stopper piston 60 receiving the hydraulic pressure from the hydraulic pressure chamber 29 in a direction of releasing the constraint becomes the first pressure receiving face and the pressure receiving face of the stopper piston 60 receiving the hydraulic pressure from the hydraulic pressure chamber 30 in the direction of releasing the constraint becomes the second pressure receiving face.

Although according to the second embodiment, the shape of the stopper piston 60 is different from that in the first embodiment, the operation of the stopper pin 60 in receiving the hydraulic pressures from the retard-side hydraulic pressure chamber 10 and the advance-side hydraulic pressure chamber 15 is the same as that in the first embodiment. That is, even if the operating hydraulic pressure is low in a state where the vane rotor 9 is disposed at the most retarded angular position in respect of the shoe housing 3, the stopper piston 60 can firmly be drawn out from the tapered hole 62*a* and the vane rotor 9 can be rotated to the advance-side side.

(Third Embodiment)

Figure 5:
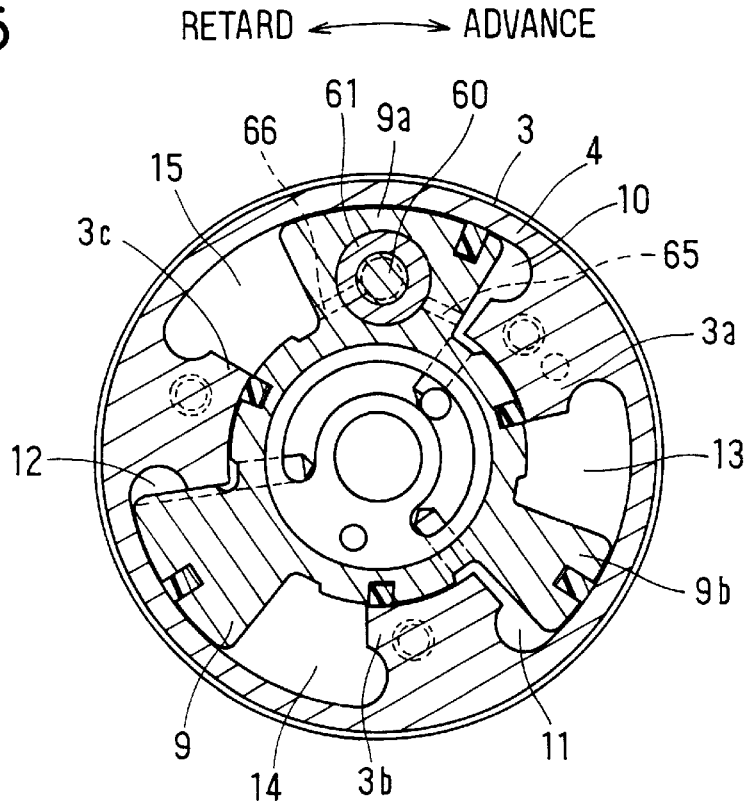
FIG. 5 is a sectional view showing a rotational phase adjusting apparatus according to a third embodiment.

In the third embodiment shown in FIG. 5, the apparatus is constructed to control valve timing of exhaust valves.

The structure of the stopper piston 60 in the third embodiment is the same as that in the second embodiment. That is, the positions of the first pressure receiving face and the second pressure receiving face of the stopper piston 60 are the same as those in the second embodiment. However, according to the stopper piston 60 in the third embodiment, the stopper piston 60 is fitted into the tapered hole of the guide ring when the vane rotor 9 is disposed at the most advanced angular position in respect of the shoe housing 3 as shown in FIG. 5 by which the relative pivotal motion between the shoe housing 3 and the vane rotor 9 is constrained. The most advanced angular position of the vane rotor 9 in respect of the shoe housing 3 is disposed on the side of the other end portion of the accomodating chamber 40 in the peripheral direction.

The hydraulic pressure received by the first pressure receiving face of the stopper piston 60 is the hydraulic pressure of the retard-side hydraulic pressure chamber 10 introduced via an oil passage 65 and the hydraulic pressure received by the second pressure receiving face of the stopper piston 60 is the hydraulic pressure of the advance-side hydraulic pressure chamber 15 introduced via an oil passage 66.

When the working oil is supplied to the retard-side hydraulic pressure chamber 10 from the state shown in FIG. 5 and the vane rotor 9 is pivoted to the retard-side side in respect of the shoe housing 3, even if the rotation speed of the engine is low and the operational hydraulic pressure is low, the stopper piston 60 is assuredly drawn out from the tapered hole and therefore, the vane rotor 9 is rotated in the retard-side direction in respect of the show housing 3.

(Fourth Embodiment)

Figure 6:
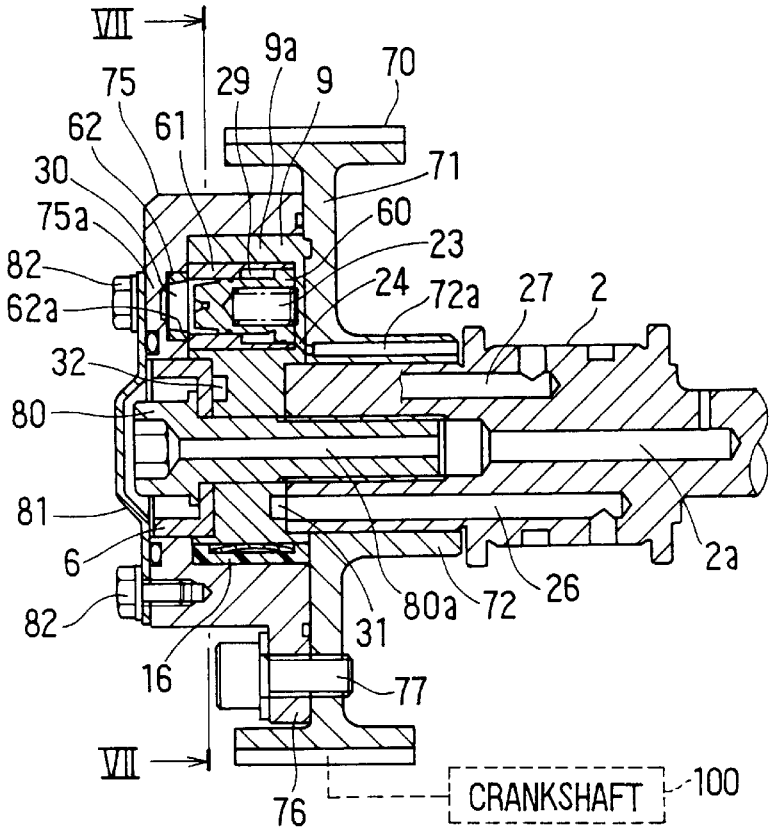
FIG. 6 is a longitudinal sectional view showing a rotational phase adjusting apparatus according to a fourth embodiment.
Figure 7:
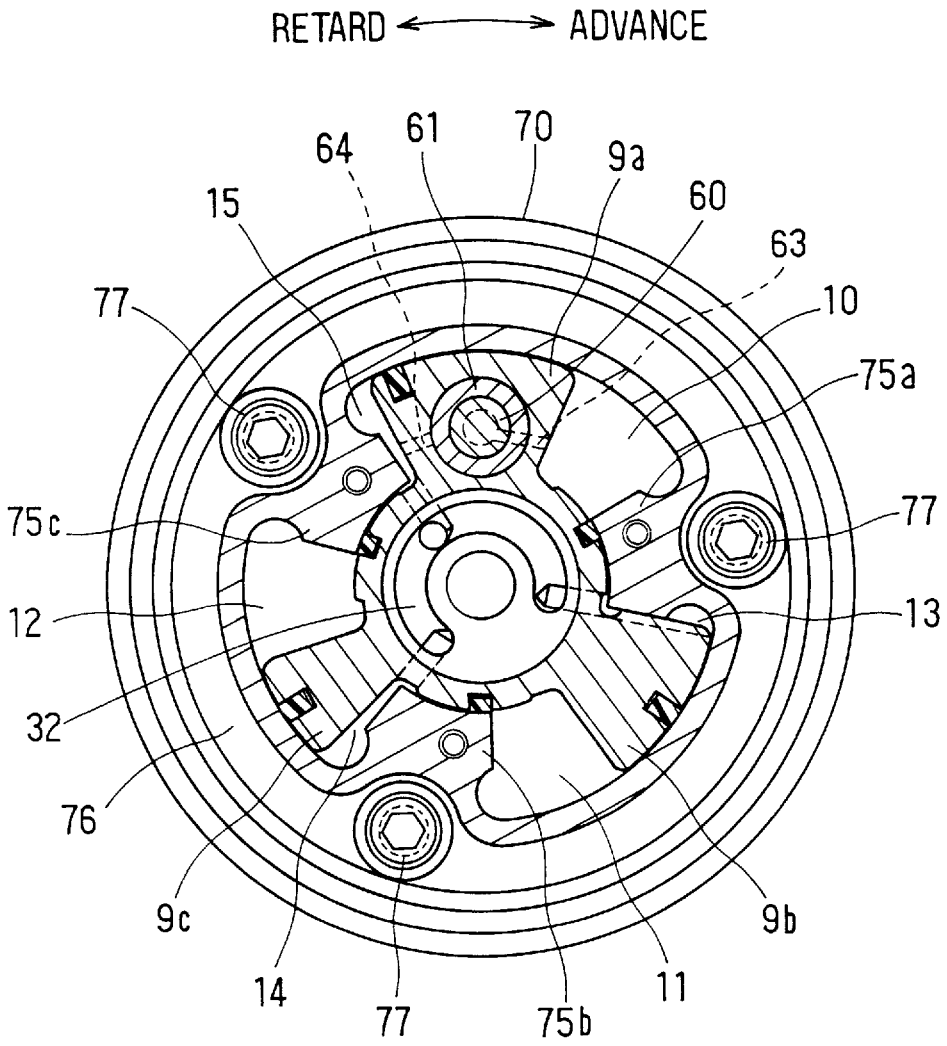
FIG. 7 is a sectional view taken along the line VII—VII in FIG. 6.

In the fourth embodiment shown in FIG. 6 and FIG. 7, the apparatus is constructed to control valve timing of intake valves as in the first and the second embodiments.

The stopper piston 60 is fitted into the tapered hole 62*a* of the guide ring 62 when the vane rotor 9 is disposed at the most retarded angular position in respect of a shoe housing 75 and the relative pivotal motion between the shoe housing 75 and the vane rotor 9 is constrained.

In this embodiment, the drive force of the crankshaft 100 is received by a timing pulley 70 via a timing belt. The timing pulley 70 comprises a flange portion 71 and a boss portion 72. A communicating passage 72*a* formed in the boss portion 72 of the timing pulley 70 is opened to the atmosphere and the movement of the stopper piston 60 is facilitated by communicating the communicating passage 72*a* with the accomodating hole 23 via the communicating passage 24.

In respect of the shoe housing 75, the peripheral wall and the side wall are integrally formed and a flange portion 76 is formed from the opening side of the peripheral wall toward the outer side in the radial direction. The timing pulley 70 and the shoe housing 75 constitute a housing member and the flange portion 71 and the flange portion 76 are coaxially fixed by fixedly screwing by bolts 77. The shoe housing 75 is provided with three vanes 75*a*, 75*b* and 75*c* as shown in FIG. 7.

The vane rotor 9 and the bushing 6 are integrally fixed to the camshaft 2 by a bolt 80.

A side wall 75*d* of the shoe housing 75 axially supporting the bushing 6 constituting the driven side rotating body on the side thereof opposed to the timing pulley 70 is covered with a cover 81 which is fixedly screwed to the shoe housing 75 by bolts 82.

The clearance between the inner peripheral wall of the boss portion of the timing pulley 70 and the camshaft 2 is provided with a long seal length so that air and the working oil in the respective hydraulic pressure chambers do not leak from the clearance. However, the clearance between the shoe housing 75 and the bushing 6 is provided with a short seal length so that air and the working oil in the respective hydraulic pressure chambers leak from the clearance. The cover 81 is attached for preventing the working oil leaked from the clearance between the shoe housing 75 and the bushing 6 from oozing to a portion coupling the timing pulley 70 and the timing belt and preventing the timing belt from slipping.

Air and the working oil leaked in the cover 81 are discharged outside of the apparatus at a position remote from the timing pulley 70 via an oil passage 80*a* provided in the bolt 80 and an oil passage 2*a* provided in the camshaft 2 and accordingly, the timing belt is prevented from being wetted by the working oil.

According to the foregoing embodiments of the present invention explained above, the stopper piston and the guide ring having the tapered hole are provided to constrain the relative pivotal motion between the shoe housing and the vane rotor at the most retarded angular position or the most advanced angular position of the vane rotor in respect of the shoe housing. Further, the first pressure receiving face and the second pressure receiving face are provided on the stopper piston as the pressure receiving faces for receiving the hydraulic pressures in the direction of drawing out from the tapered hole and the pressurized area of the first pressure receiving face is set to be larger than the pressurized area of the second pressure receiving face. Thereby, by applying the hydraulic pressure of the advance-side hydraulic pressure chamber on the first pressure receiving face when the relative pivotal motion is constrained at the most retarded angular position and by applying the hydraulic pressure of the retard-side hydraulic pressure chamber on the first pressure receiving face when the relative pivotal motion is constrained at the most advanced angular position, in the case where the vane rotor is pivoted from the constrained position to the advance-side direction or the retard-side direction, even if the hydraulic pressure of the working oil is low at low rotation of the engine, the stopper piston can assuredly be drawn out from the tapered hole and the relative pivotal motion between the shoe housing and the vane rotor, that is, the relative phase control of the camshaft in respect of the crankshaft can be performed. Accordingly, the valve timing can assuredly be adjusted without enlarging the driving source and without enlarging the abutting portion and with the limited drive force of the driving source and the limited pressured area of the abutment portion.

Further, according to the foregoing embodiments, the stopper piston is moved in the axial direction and fitted into the tapered hole, however, the apparatus may be so constructed that the stopper piston is moved in the radial direction to be fitted into the tapered hole can be constructed.

Further, according to the foregoing embodiments, the rotational drive force of the crankshaft is transmitted to the camshaft by the timing gear or the timing pulley, however, a chain sprocket or the like may be used alternatively. Further, the drive force of the crankshaft as the driving shaft can be received by a vane member whereby the camshaft as the driven shaft and the housing member can be integrally rotated.

The present invention should not be limited to the disclosed embodiments and modifications but may be altered further without departing from the spirit of the invention.

We claim:

1. A rotational phase adjusting apparatus for adjusting a rotational phase between a driving shaft and a driven shaft, comprising:

a first chamber for changing the rotational phase of the driving shaft and the driven shaft in one direction by introducing a first fluid pressure;

a second chamber for changing the rotational phase of the driving shaft and the driven shaft in the other direction by introducing a second fluid pressure; and a constraining member for fixing the rotational phase between the driving shaft and the driven shaft, the constraining member having a first pressure receiving surface or face for receiving the first fluid pressure and a second pressure receiving surface or face for receiving the second fluid pressure so that a state of constraint is changed by the first and the second fluid pressures, wherein the first pressure receiving face is larger than the second pressure receiving face.

2. The apparatus according to claim 1, wherein:

the constraining member is constructed to fix the rotational phase between the shafts when the driven shaft is disposed at a most retarded angular position in respect of the driving shaft; and the first chamber is constructed to change the rotational phase of the driving shaft and the driven shaft in an advance-side direction by the first fluid pressure.

3. The apparatus according to claim 1, wherein:

the constraining member is constructed to fix the rotational phase between the shafts when the driven shaft is disposed at a most advanced angular position in respect of the driving shaft; and the first chamber is constructed to change the rotational phase between the driving shaft and the driven shaft in a retard-side direction by the first fluid pressure.

4. The apparatus according to claim 1, wherein:

the constraining member includes a stopper piston having a front end face as the first pressure receiving face and a flange portion as the second pressure receiving face.

5. The apparatus according to claim 1, further comprising:

passages for applying the first fluid pressure to the first chamber; and a passage for introducing the first fluid pressure from the first chamber on the first pressure receiving face.

6. The apparatus according to claim 5, further comprising:

passages for applying the second fluid pressure to the second chamber; and a passage for introducing the second fluid pressure from the second chamber on the second pressure receiving face.

7. The apparatus according to claim 1, further comprising:

a housing member forming an accomodating chamber extending along a circumferential direction; and a vane member arranged in the accomodating chamber and capable of pivoting relative to the housing member in a predetermined angular range corresponding to the accomodating chamber, wherein the housing member and the vane member define the first chamber and the second chamber therebetween.

8. The apparatus according to claim 7, wherein:

the constraining member includes a stopper piston accomodated in the vane member and fitted into a hole provided in the housing member for constraining the shafts.

9. The apparatus according to claim 8, wherein:

the vane member has a passage reaching the second pressure receiving face from the second chamber.

10. The apparatus according to claim 7, wherein:

the constraining member is constructed to fix the rotational phase between the shafts when the driven shaft is disposed at a most retarded angular position in respect of the driving shaft; and the first chamber is constructed to change the rotational phase of the driving shaft and the driven shaft in an advance-side direction by the first fluid pressure.

11. The apparatus according to claim 7, wherein:

the constraining member is constructed to fix the rotational phase between the shafts when the driven shaft is disposed at a most advanced angular position in respect of the driving shaft; and the first chamber is constructed to change the rotational phase between the driving shaft and the driven shaft in a retard-side direction by the first fluid pressure.

12. The apparatus according to claim 7, wherein:

the constraining member includes a stopper piston having a front end face as the first pressure receiving face and a flange portion as the second pressure receiving face.

13. The apparatus according to claim 7, further comprising:

passages for applying the first fluid pressure to the first chamber; and a passage for introducing the first fluid pressure from the first chamber on the first pressure receiving face.

14. The apparatus according to claim 13, further comprising:

passages for applying the second fluid pressure to the second chamber; and a passage for introducing the second fluid pressure from the second chamber on the second pressure receiving face.

15. The apparatus according to claim 1, wherein:

the driving shaft includes a crankshaft of an engine; and the driven shaft includes a camshaft of the engine for opening and closing at least one of intake valves and exhaust valves of the engine.

* * * * *